United States Patent [19]

Herbert

[11] Patent Number: 4,466,548

[45] Date of Patent: Aug. 21, 1984

[54] CONTAINER AND CLOSURE AND METHOD FOR APPLYING A CLOSURE TO A CONTAINER

[75] Inventor: James F. Herbert, Staffordshire, England

[73] Assignee: Metal Closures Limited, England

[21] Appl. No.: 432,952

[22] PCT Filed: Mar. 5, 1982

[86] PCT No.: PCT/GB82/00073

§ 371 Date: Sep. 30, 1982

§ 102(e) Date: Sep. 30, 1982

[87] PCT Pub. No.: WO82/03059

PCT Pub. Date: Sep. 16, 1982

[51] Int. Cl.[3] ..... B65D 51/16

[52] U.S. Cl. ..... 215/307; 53/488

[58] Field of Search ..... 215/307, 337; 53/488, 53/334

[56] References Cited

U.S. PATENT DOCUMENTS

| | | | |
|---|---|---|---|
| 1,160,596 | 11/1915 | Hammer | 215/337 |
| 1,579,942 | 4/1926 | Jensvold | 215/337 X |
| 1,783,314 | 12/1930 | Scofield | 215/337 |
| 3,039,247 | 6/1962 | Thomas et al. | 53/488 |
| 3,648,874 | 3/1972 | Moller | 215/337 X |
| 3,775,944 | 12/1973 | Roberts | 53/334 |

FOREIGN PATENT DOCUMENTS

| | | | |
|---|---|---|---|
| 2447329 | 9/1980 | France | 215/307 |
| 2029808 | 3/1980 | United Kingdom | 215/307 |

*Primary Examiner*—Donald F. Norton
*Attorney, Agent, or Firm*—Roland T. Bryan

[57] ABSTRACT

In a combination of a screw-threaded metal closure cap with a container having an externally screw-threaded neck, of the type in which the closure thread is formed by a thread rolling operation in a blank in situ on the container, one or more interruptions are made in the closure thread to provide a pressure leakage path, through which gas can blow off in the interval between unsealing the container and the release of the closure from the container thread.

Complementary notches may be formed in the container thread.

The interruptions in the closure thread are conveniently provided by forming the thread by means of a thread roller having one or more notches in its periphery.

4 Claims, 6 Drawing Figures

CONTAINER AND CLOSURE AND METHOD FOR APPLYING A CLOSURE TO A CONTAINER

The present invention relates to screw closures for containers having externally screw-threaded necks and in particular to screw closures of the type in which the thread is rolled in situ by inwardly deforming the skirt of a cup-shaped metal blank between adjacent turns of the screw thread on the container neck. The invention is also concerned with apparatus for applying the closure blanks to such containers.

A screw-capped bottle containing a carbonated beverage is susceptible to release a large quantity of carbon dioxide from solution as a result of shaking. As discussed in British Patent Specification No. 2,029,808, this may involve somewhat violent release of the cap when fully unscrewed. In that Specification it was proposed that one or more transverse notches be formed in the container thread and/or in the closure cap thread to allow the pressurised gas to blow off after release of the seal between the cap gasket and the container and before complete removal of the cap from the container. In other words at least part of the gas pressure is released across the threads, via the notches, whilst the closure cap thread is still engaged with the container thread. This release of pressure reduces or avoids the danger of the closure cap flying off on becoming fully unscrewed from the container.

In the prior proposal the notches both in the container thread and in the cap thread were preformed. We have now realised that the principle of the prior proposal can be adapted to rolled-on closures, in which the notches cannot be preformed.

According to one aspect of the invention there is provided a combination of a container and closure of the type in which the thread is formed by inwardly deforming the skirt of a cup-shaped metal blank wherein the inwardly-directed closure thread is interrupted at at least one position along its length to provide at least one notch for release of pressurised gas during unscrewing the cap.

In the container-closure combination of the present invention the neck of the bottle or other container is preferably provided with at least one vertical groove, forming a notch through each turn of the container thread to form a gas escape passage, which becomes particularly effective when it is brought into register with like notches in the cap thread.

It is preferred to provide more than one such vertical groove in the container thread and/or to provide notches in the cap thread at angular intervals of substantially less than 360°. In the normal course of applying closure blanks to containers by the roll-on method the containers are presented in random orientation to the capping machinery and it is impracticable to relate a notch or notches in the cap thread formed by rotating thread rollers with the start or starts of the container thread. By adopting this preferred arrangement registration of a container thread groove with a cap thread notch is ensured before the cap has been turned 360°.

In conventional rolled-on closures, the closure thread is normally formed by pressing at least one free-turning roller against the closure skirt, the rollers being narrow and deforming the metal, generally aluminium, into the valleys between the neck threads and being arranged to follow such threads. As the roller is rolled around the closure, it follows the neck thread down and runs out at the bottom of the neck thread, leaving the closure firmly engaged with the neck thread.

Conventional metal closure blanks are somewhat oversize in relation to the container thread and the skirt becomes somewhat reduced in diameter over the apices of the container thread as a result of the action of the thread rollers. Where an interruption is provided in the rolled closure thread, there tends to be greater clearance between the closure and the adjoining container thread apices at such position, to provide an improved gas leakage path. In consequence notches in the container thread are not essential for the improved container/closure combination, in which notch-forming interruptions are provided in the thread rolled into the closure skirt.

According to another aspect of the invention a method of securing a cup-shaped metal closure blank to a container having an externally screw-threaded neck, comprising placing the blank over the container mouth and pressing it down against the container mouth to close and seal the mouth and deforming the skirt of the blank inwardly between adjacent outwardly-projecting thread formations on the container neck to produce inwardly-projecting thread formations in said thread is characterised by interrupting said inward deformation at one or more positions to define a notch or notches in such inwardly-projecting thread formations.

According to another aspect of the invention, a head set, for applying a closure blank to an externally screw-threaded container comprises a pressure block for applying vertical pressure to press the blank into sealing relationship with the mouth of a container and at least one thread-forming roller movable radially inwardly to deform the wall of the skirt of the closure blank between adjacent turns of the container thread and arranged to follow the trough between adjacent container thread turns to form a thread in said closure skirt is characterised in that said thread roller is provided with at least one cut-out in its periphery so that there is a corresponding interruption in the closure thread formed thereby. The cut-out or cut-outs in the roller or rollers may be of various shapes, for example semi-circular, vee or rectangular. The corners of the cut-outs may be sharp corners or radiused.

Conventionally in a headset employed for applying closure blanks of the present type a plurality of thread-forming rollers are used, with the rollers arranged around the axis of rotation of the headset in such manner that the radial forces with which they are urged against the closure are balanced. If a plurality of notched thread-forming rollers are used they may be geared, or otherwise ganged to turn in synchronism with each other about their respective axes, to ensure that the notch or notches left by one roller are not rolled out by the next roller, but rather that a cut-out in the next roller registers with the previously-left interruptions in the thread. Alternatively, where the closure is of the pilferproof type, in which the free end of the skirt is tucked under an abutment shoulder on the container neck, a single notched-thread forming roller may be employed together with one or more tuck-under rollers so positioned to balance the roller forces. A further alternative is to oppose a single thread-forming roller by one or more plain rollers which bear against the closure skirt over the apices of adjacent projecting container thread formations and thus do not deform the closure skirt inwardly between said formations. A further alternative is to rely upon the pressure block, which is strongly urged onto the top of the closure, to resist the thread-roller force.

To help understanding of the invention, a specific embodiment thereof, with variations, will now be described with reference to the accompanying drawings, in which.

Figure 1:
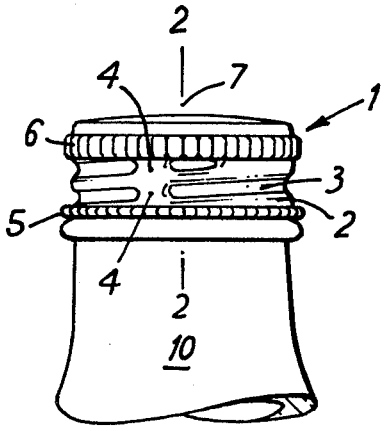
FIG. 1 is a side view of a notched thread closure cap on a bottle neck.
Figure 2:
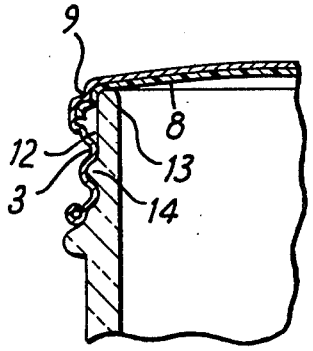
FIG. 2 is a vertical cross-section through half of the closure cap and the bottle neck on line 2—2 of FIG. 1.

The cap of FIG. 1 has a skirt 2 in which is rolled a thread 3 having notches 4, which may be aligned as shown or displaced from each other. Preferably there are notches 4 at two or more positions in each turn of the inwardly directed thread. As is conventional the cap has a rolled bead 5 and a knurled grip 6. The cap is provided with a layer 8 of gasket material which covers the top 7 and extends onto the upper portion of the skirt 2 to form a sealing gasket. At this region the cap is deformed at 9 during application of the blank to the container 10, which may be of plastics material or of glass, by a pressure block 11, see FIG. 5, to seal on the outer cylindrical surface 12 (FIG. 2) of the container adjacent the mouth 13. Also shown in FIG. 2 is the thread form of both the neck thread 14 and the rolled cap thread 3. On initial application the thread 3 is held in close contact with the underside of the neck thread 14 by the upward thrust due to the gas pressure exerted by the contents of the bottle.

When the cap 1 is unscrewed, the seal between the gasket material and the cylindrical surface 12 remains effective until the cap has been turned through approximately ¼ of a revolution. In a conventional closure, in which there are no thread notches 4, rapid escape of gas is still prevented by the engagement of the thread 3 on the underside of the container thread 14.

Figure 3:
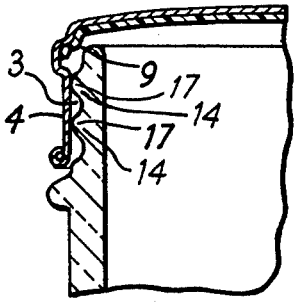
FIG. 3 is a vertical cross-section showing the closure cap partially unscrewed and a closure thread notch bridging the gap between the top two ridges of the neck thread.

FIG. 3 shows a section of a skirt thread notch 4 with the cap partially unscrewed, with a notch 4 bridging container threads 14. A limited escape of gas pressure can now take place over the apices 17 of the individual neck threads 14 and through the notch 4 in the still engaged skirt thread.

Figure 4:
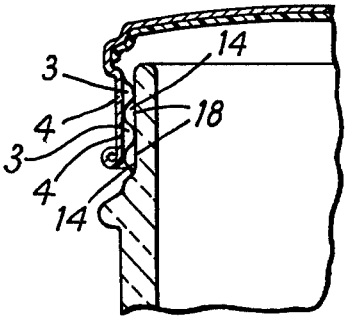
FIG. 4 is a vertical cross-section similar to FIG. 3 showing the thread notch in alignment with two aligned neck thread notches.

In FIG. 4 a thread notch 4 is in register with vertically aligned notches 18 in the individual neck threads 14. When this alignment occurs a very rapid blow-off of gas can take place.

Figure 5:
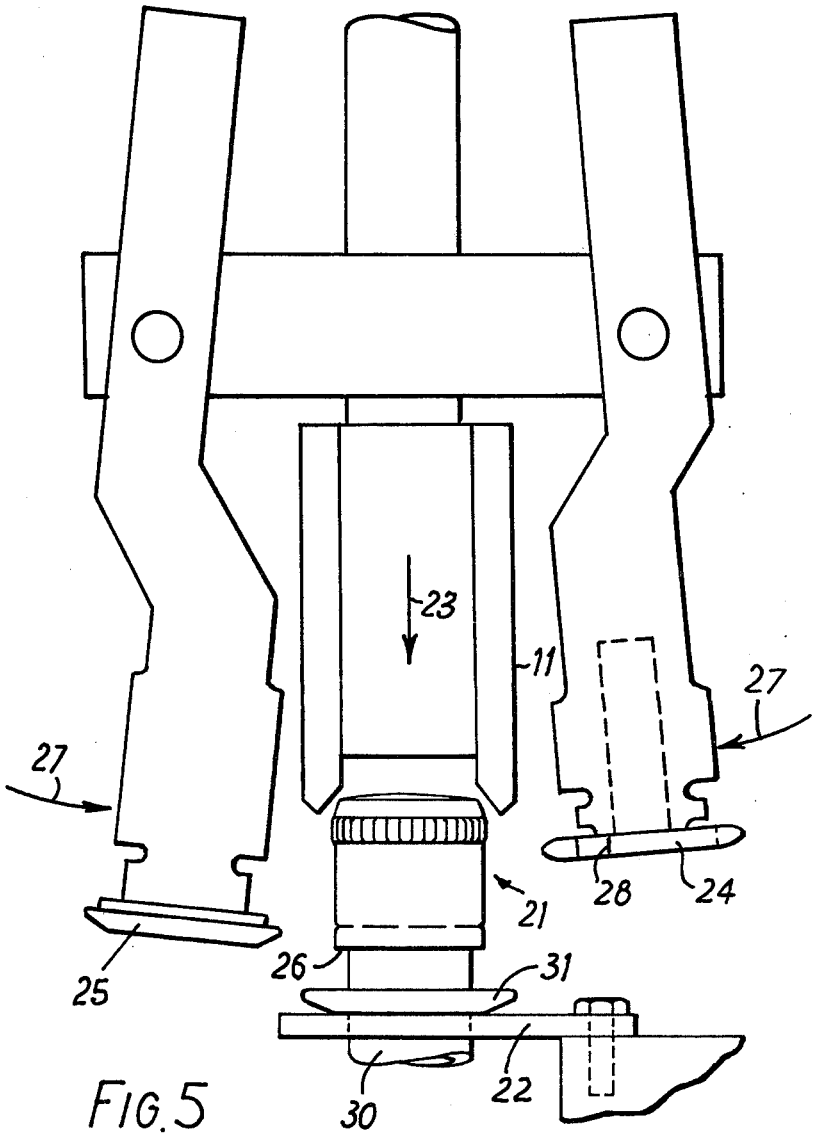
FIG. 5 shows a diagrammatic view of a pilfer-proof closure cap immediately before commencement of sealing to a bottle by a sealing machine.

FIG. 5 shows the blank 21 of a pilfer-proof cap at the start of application to the neck of a blow-moulded plastic bottle 30 by a sealing machine which includes a support 22 on which an integral bottle collar 31 rests, because the bottle body cannot withstand heavy axial pressure exerted by a conventional two-part pressure block 11. The block 11 is urged downwards in the direction of arrow 23 to press the closure blank against the bottle mouth and to deform the closure at 9 to establish a seal with the cylindrical surface on the bottle neck. A thread roller 24 is mounted in conventional manner to turn about the axis of the headset of which the pressure block 11 also forms part. The roller 24 and an opposed tuck-under roller 25 for the security band 26 of the closure are mounted on lever arms (not shown) for movement towards and away from the bottle neck to balance the forces with which the rollers are urged in the direction of arrows 27. In the construction of FIG. 5 there are preferably at least two tuck-under rollers arranged at 120° intervals to balance the force exerted by a single thread roller 24. The rollers 24, 25 are mounted in the conventional way on pivoted arms and are moved inwards in the direction of the arrows 27 by conventional spring, hydraulic or pneumatic means to press against the skirt of the closure blank.

As the rollers are rotated around the axis of pressure block 11 in the well-known manner, the thread-forming roller 24 runs down the closure skirt in the trough between adjacent turns of the bottle thread 14 to deform the skirt into engagement with the thread 14 and to form the cap thread 3.

Where the bottle to be capped is of robust construction and the body of the bottle is capable of withstanding the crushing load applied by the headset, then the support 22 would be eliminated and the bottle supported on a table or the like in the conventional manner.

Where the headset is employed to apply conventional plain closure blanks, having an outwardly curled bead at the bottom margin of the skirt, the tuck-under rollers are preferably replaced by plain rollers having a cylindrical profile to counteract the thread roller 24.

Figure 6:
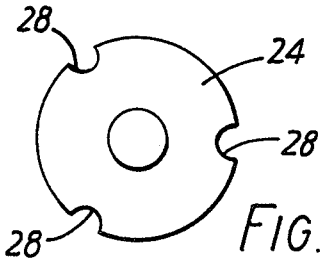
FIG. 6 is a plan view of the notched-thread forming roller of the sealing machine.

As shown in FIG. 6 the thread roller 24 has a number of notch-forming cut-outs 28.

The diameter of the thread roller need have no particular relationship to the diameter of the closure or bottle neck and indeed will be employed in practice (with suitable change of pressure block and other items) to apply closures to bottle necks of different diameter. It is however necessary that the peripheral distance between adjacent cut-outs is no more than the circumference of the neck to which a closure is applied to ensure that there is at least one notch in each turn of the neck thread.

The closure/container combination illustrated in the accompanying drawings may be varied in a number of details. As already indicated it is not essential to provide any notch in the container thread. However where notches are provided in such container thread, they may be aligned in the vertical direction as shown in FIG. 4 or may be arranged at intervals along the length of the helical container thread so as not to be in vertical alignment.

Similarly the notches in the closure thread may be vertically aligned as shown in FIG. 1. However, where such notches are formed by the thread roller of FIG. 6, the spacing between the notches is dependent upon the relationship between the container neck circumference and the peripheral distance between adjacent notches 28 in the roller periphery. In many instances the closure thread notches will be at staggered intervals around the container neck.

The roller 24, shown in FIG. 5, may be mounted on arms which pivot about a vertical axis, parallel to the axis of the pressure block 11. The same modification may be made with respect to the mounting of the tuck-under rollers 25 or plain rollers which may replace the rollers 25.

I claim:

1. A combination of a container having an externally screw-threaded neck and a metal closure cap formed from a cup-shaped blank, having a plain cylindrical wall, in which thread is formed, the container being sealed by a gasket within said cap, pressed down against the mouth of said container, said closure being secured to said container by means of separate, longitudinally aligned, inwardly projecting lengths of thread formed by inwardly deforming said plain cylindrical wall between adjacent turns of the container thread, said inwardly projecting aligned lengths of thread being separated at intervals by undeformed portions of said plain cylindrical wall, such interruptions constituting transverse notches in said closure thread to allow passage of gas transversely of said closure thread.

2. A combination according to claim 1 further characterised in that a transverse notch is formed in each turn of the container thread.

3. A combination according to claim 2 or 1 further characterised in that the notches in the cap thread are spaced at angular intervals of less than 360°.

4. A method of securing a cup-shaped closure blank, carrying a sealing gasket, to a container having an externally screw-threaded neck, comprising placing the blank over the container mouth and pressing down on the top of said blank to bring the gasket into sealing relationship with the container mouth, progressively pressing the skirt of the blank inwardly between adjacent outwardly-projecting thread formations by means of a thread roller to form inwardly projecting thread formations in the wall of said blank, intermittently interrupting the inward pressure of said roller to leave undeformed portions of the closure blank wall between aligned inwardly directed thread ridges, said undeformed portions constituting transverse notches in the closure thread for passage of gas transversely of said closure thread and releasing downward pressure on the top of said closure on completion of the formation of thread in the wall of the closure.

* * * * *